US005779232A

United States Patent [19]

Öchsner

[11] Patent Number: 5,779,232

[45] Date of Patent: Jul. 14, 1998

[54] METHOD AND DEVICE FOR THE PRODUCTION OF A LONGITUDINAL FOLD

[75] Inventor: Rudolf Phillip Öchsner, Beindersheim, Germany

[73] Assignee: Koenig Bauer-Albert Aktiengesellschaft, Wurzburg, Germany

[21] Appl. No.: 663,259

[22] PCT Filed: Dec. 23, 1994

[86] PCT No.: PCT/DE94/01533

§ 371 Date: Jun. 24, 1996

§ 102(e) Date: Jun. 24, 1996

[87] PCT Pub. No.: WO95/18057

PCT Pub. Date: Jul. 6, 1995

[30] Foreign Application Priority Data

Dec. 24, 1993 [DE] Germany ..... 43 44 603.5

[51] Int. Cl.[6] ..... B42C 1/00; B31F 1/00

[52] U.S. Cl. ..... 270/45; 270/52.14; 493/423; 493/435; 493/444

[58] Field of Search ..... 240/32, 45, 51, 240/52.14; 493/423, 435, 436, 437, 441, 444, 445

[56] References Cited

U.S. PATENT DOCUMENTS

| | | | |
|---|---|---|---|
| 3,961,783 | 6/1976 | Beaudoin | 493/423 |
| 4,022,457 | 5/1977 | Marlin et al. | 493/423 X |
| 4,053,150 | 10/1977 | Lane | 493/444 X |
| 4,487,598 | 12/1984 | McDonald . | |
| 4,586,917 | 5/1986 | Robinson . | |
| 4,614,512 | 9/1986 | Capdeboscq | 493/441 |
| 4,746,108 | 5/1988 | Hirayama et al. . | |
| 4,747,817 | 5/1988 | Newsome . | |
| 5,169,376 | 12/1992 | Ries et al. | 493/435 X |
| 5,222,934 | 6/1993 | Öchsner . | |

FOREIGN PATENT DOCUMENTS

| | | | |
|---|---|---|---|
| 0 068 341 | 1/1983 | European Pat. Off. . | |
| 261 461 | 6/1913 | Germany . | |
| 571 796 | 3/1933 | Germany . | |
| 1 089 776 | 9/1960 | Germany . | |
| 23 30 513 | 1/1975 | Germany . | |
| 24 50 113 | 6/1978 | Germany . | |
| 29 07 652 | 12/1983 | Germany . | |
| 32 39 799 | 4/1986 | Germany . | |
| 37 07 478 | 10/1987 | Germany . | |
| 41 16 992 | 11/1992 | Germany . | |
| 60-148759 | 10/1985 | Japan . | |
| 61-2671 | 1/1986 | Japan . | |
| 62-16443 | 4/1987 | Japan . | |
| 2-80663 | 6/1990 | Japan . | |
| 4-49169 | 2/1992 | Japan . | |
| 4-85265 | 3/1992 | Japan . | |
| 5-1816141 | 7/1993 | Japan . | |
| 410 997 | 10/1966 | Switzerland . | |
| 511231 | 8/1976 | U.S.S.R. | 493/437 |
| 2 006 170 | 5/1979 | United Kingdom . | |

*Primary Examiner*—Hoang Nguyen
*Attorney, Agent, or Firm*—Jones, Tuller & Cooper, P.C.

[57] ABSTRACT

A signature to be folded in a folding device is first provided with a pre-fold that is formed along the intended fold line. The signature is conveyed through a linear guide where it is pre-folded. The pre-folded signature is then delivered to a folding device where it is folded by being caused to pass between a pair of folding rollers.

34 Claims, 5 Drawing Sheets

METHOD AND DEVICE FOR THE PRODUCTION OF A LONGITUDINAL FOLD

FIELD OF THE INVENTION

The invention relates to a method and a device for producing a longitudinal fold in a signature by supplying the signatures to a longitudinal folding device with the signatures already provided with a pre-fold.

DESCRIPTION OF THE PRIOR ART

Longitudinal folding devices and associated transport systems are known generally from U.S. Pat. No. 4,746,108 as well as from German Patent Publication DE 32 39 799 C2.

A transport device for signatures in a folding device of a web-fed rotary printing press is known from U.S. Pat. No. 5,222,934, by means of which the signatures are guided between two conveyor belts, are aligned at a stop and impact surface and are subsequently inserted into a longitudinal folding device for making a so-called third fold.

SUMMARY OF THE INVENTION

It is the object of the invention to provide a method and a device for producing a longitudinal fold, for example a so-called second longitudinal fold, at high production speeds.

Signatures to be provided with a longitudinal fold are clamped left and right of the intended fold line by, for example, upper and lower conveyor belts and are then moved into position so that they can be longitudinally folded. Various pushing devices are usable to move the signatures into the position where they are longitudinally folded. The signatures to be folded are provided with a pre-fold before they are longitudinally folded.

The following advantages in particular are achieved by present the invention. Time, as well as the alignment of the signatures while they are stopped, is saved because of pre-forming the signatures along an imaginary fold line while they are being conveyed to a folding device. Furthermore, the lift of the folding blade is drastically reduced by pre-forming the signatures. In accordance with further preferred embodiments, an up-and-down moving folding blade is completely omitted, so that the reversal of the direction of movement of the folding blade is no longer needed and in this way the quiet running of the folding device is improved. It is also possible in accordance with another preferred embodiment of the invention to perform the complete folding process in a straight conveying direction of the signatures.

BRIEF DESCRIPTION OF THE DRAWINGS

Several preferred embodiments of the present invention are represented in the drawings and will be described in more detail in what follows. Shown are in.

DETAILED DESCRIPTION OF THE PREFERRED EMBODIMENTS

Figure 1:
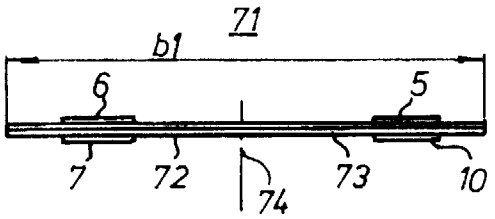
FIGS. 1 to 3, schematic representations of the method steps of the method of the invention, in accordance with the present invention.
Figure 2:
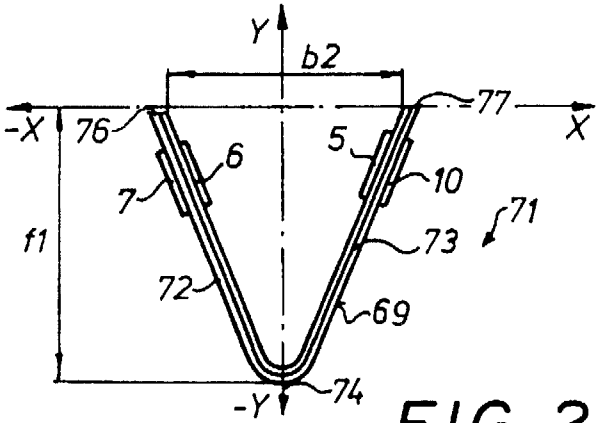
Figure 3:
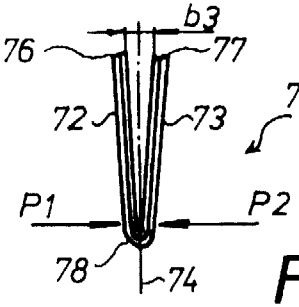

In accordance with the method of the invention, a printed product composed of several sheets of paper, for example a signature 71 composed of several sheets, is grasped in a sandwich-like manner at its left and right elements or portions 72, 73 along, and parallel to an intended fold line 74 by holding means, for example by upper and lower conveyor belts 6, 7, 5, 10 as seen in FIG. 1, so that the elements or portions 72, 73 are placed between the conveyor belts 6, 7, 5 and 10. Respectively one element 72 or 73 can also be grasped and guided by several conveyor belts 6, 7, 5, 10, not shown, which are arranged parallel in relation to each other. The left and right elements 72, 73 of the signature 71, originally spaced at a distance b1 are now moved toward each other as far as a pre-selectable inner distance b2, measured across the top sheet of their ends 76, 77. Viewed in profile, the left and right elements 72, 73 of the signature 71 perform a movement in the X-direction as well as the Y-direction of a right-angled coordinate system as depicted in FIG. 2. In the process, the belts 6, 7, 5, 10 also change their position in relation to each other, i.e. from their prior first position in the direction of the X-axis into an inclined position, wherein the edges of the belts 6, 7, 5, 10 are arranged in a V shape separated by the distance b2 of the ends 76, 77. Subsequently both elements 72, 73 of the signature 71 are pressed together by a force P1, P2, as seen in FIG. 3 acting to the left and right of the fold line 74, so that a fold 78 is created. In this case the forces P1, P2 act in an area close along the intended fold line 74 as shown in FIG. 3 and the distance b between the ends 76, 77 is further reduced to b3 as depicted. The more the distance b of the lateral ends 76, 77 of the signature 71 is reduced, the greater the movement of the left and right elements 72, 73 of the signature 71 in the X–Y-direction. There is a distance f1 between the ends 76, 77 of the signature 71 and a lowermost sheet 69 of the signature 71 at its fold line 74.

Figure 4:
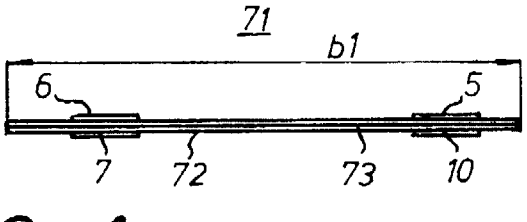
FIGS. 4 to 6, schematic representations of the method steps of the method of the invention for a second preferred embodiment, FIGS. 7 to 9, front views of devices in accordance with the invention for producing a fold, FIG. 10, a top view of a further device for producing a fold, FIG. 11, a lateral view F from FIG. 10, FIG. 12, a lateral view of an embodiment of a device of the invention, but without an inlet panel and without signatures, FIG. 13, a section along the line XIII—XIII of FIG. 12.
Figure 5:
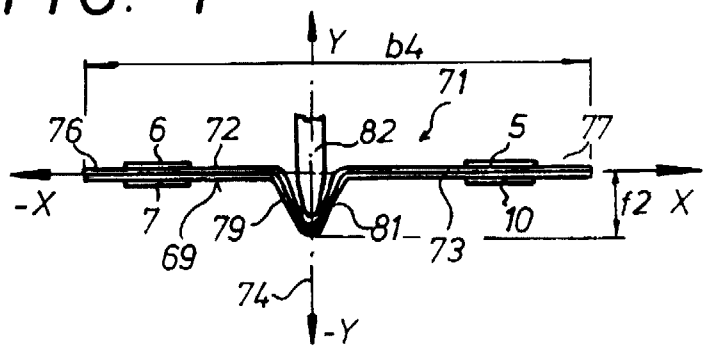
Figure 6:
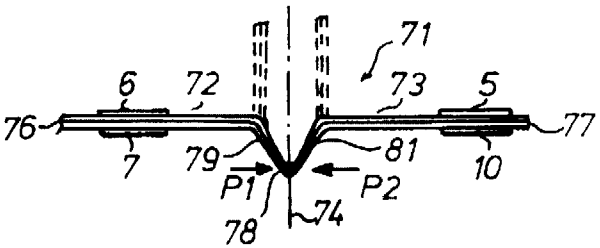

In accordance with a further preferred embodiment of the method of the invention, based on the position of the signatures 71 in an X-direction (distance b1 of the ends 76, 77) or in a Y-plane as seen in FIG. 4, only the portions 79, 81 of the left and right elements 72, 73 of the signatures 71 which are located in the area of the intended fold line 74 are moved toward each other in the X- and Y-directions of a right-angled coordinate system by the distance b4, shown in FIG. 5. In this case the lateral ends 76, 77, i.e. the long edges of the signature 71 only move in the X-direction of the right-angled coordinate system. In the process, the lowermost sheet 69 of a smoothed signature 71 is brought along its fold line 74 into a position on the Y-axis at a distance f2 from the X-axis. A fold 78 shown in FIG. 6 is also created by the subsequent action of forces P1, P2, which act on both sides of the fold line 74 on the portions 79, 81 or the close area next to the fold line 74 of the signatures 71 and press them together. A representation in dashed lines in FIG. 6 shows a fold in a signature 71 which was finished later.

Figure 12:
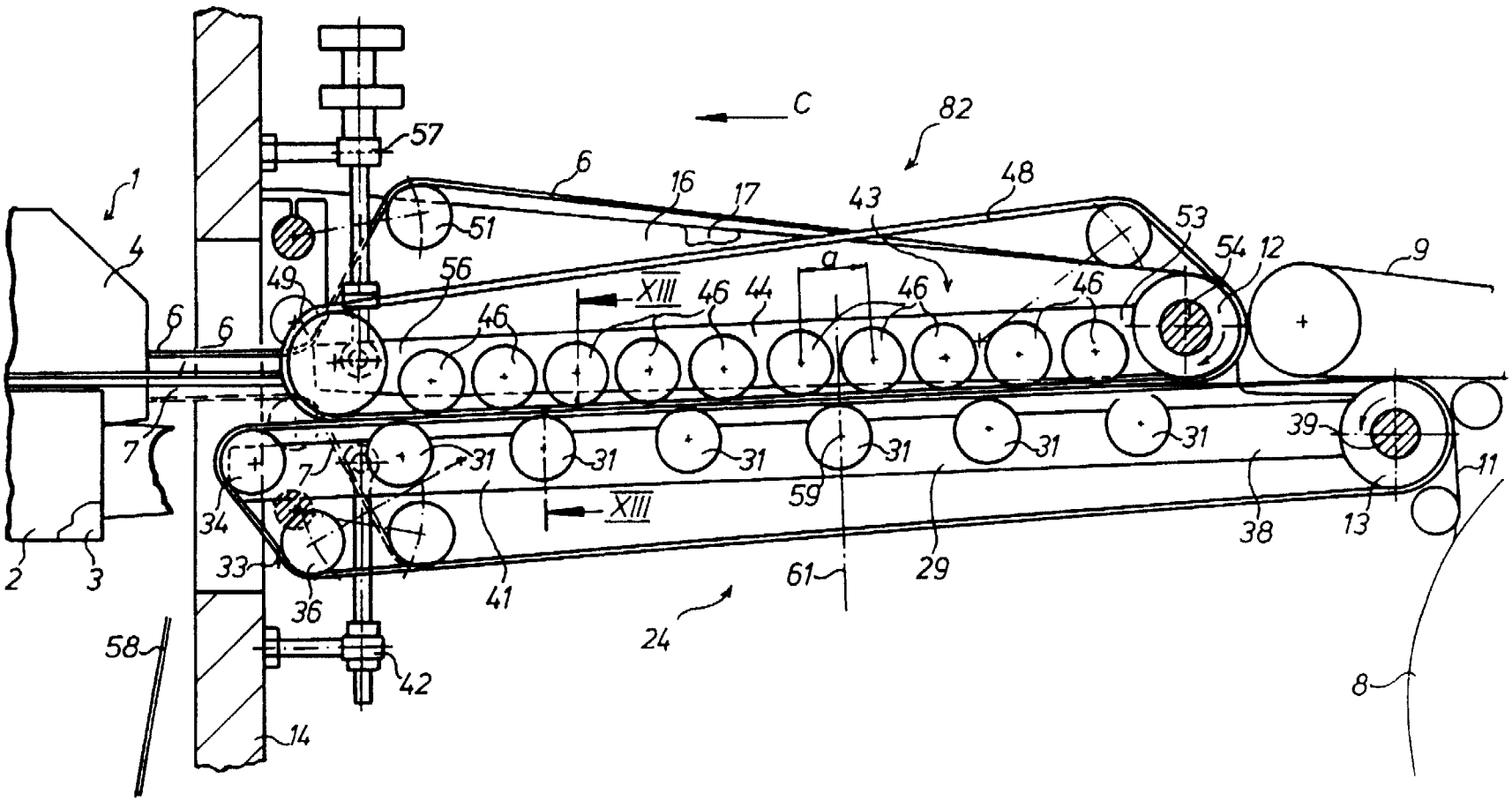

During the movement, viewed in profile, of the left and right elements 72, 73 of the signatures 71 in the X-, Y-direction, the signatures 71 can be simultaneously moved in a transport direction C directed toward a longitudinal folding device 1, which is performed by means of the conveyor belts 6, 7, 5, 10 as seen in, for example FIG. 12. In this case a longitudinal guide 82 extending in the transport direction C and resiliently resting against the fold line 74 of the signatures 71 as shown in FIG. 5 can be provided above the fold line 74. This will be described later. The left and right elements 72, 73 of the signature 71 can be embodied to be symmetrical in respect to the fold line 74, i.e. be in the center, or asymmetrical.

Figure 7:
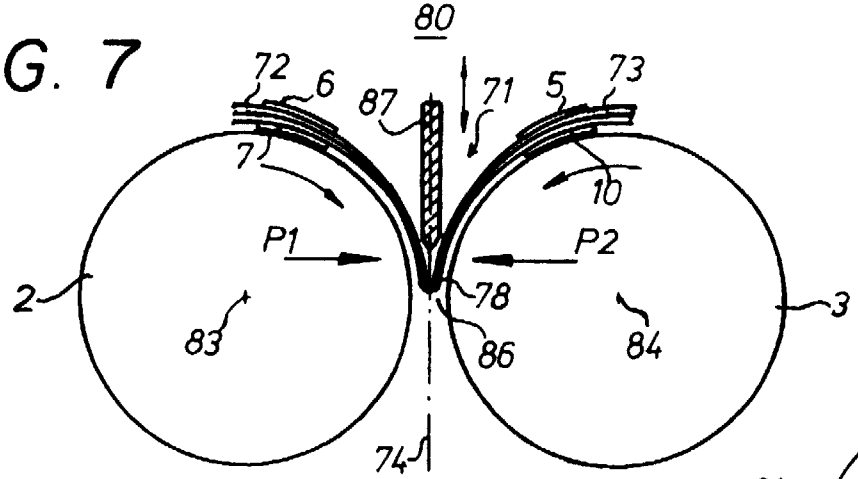
Figure 11:
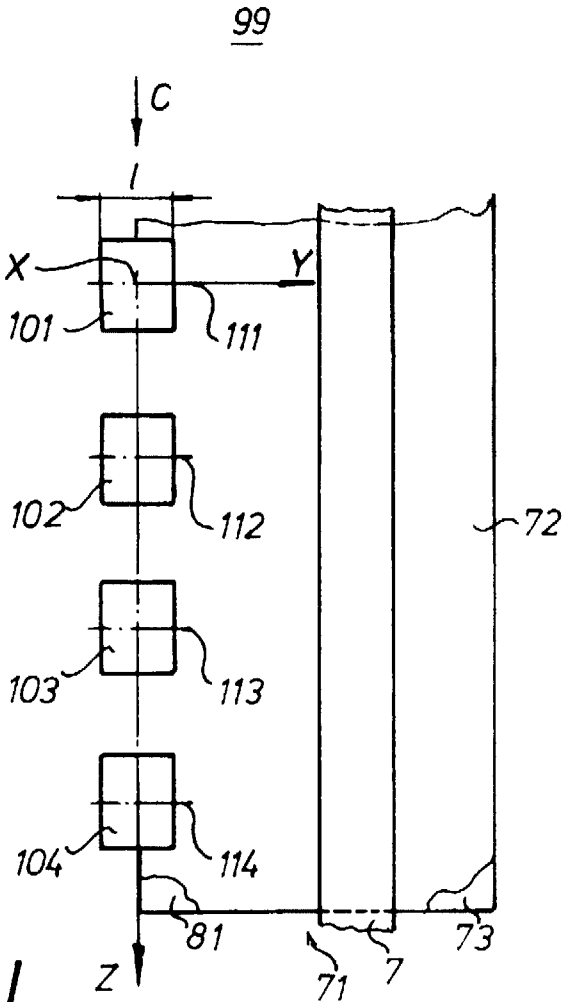

To make the fold 78 in the signatures 71, the forces P1, P2 act in a compressing manner on the portions 79, 81 in the area of the fold line 74 as seen in FIGS. 3 and 4. Different preferred embodiments of the device for producing a fold are shown in FIGS. 7 to 10. The transport direction C simultaneously corresponds to an axis Z of a right-angled coordinate system as seen in FIG. 11. A first longitudinal folding device, identified as a whole by 80 as seen in FIG. 7, will be described first. A folding blade 87, which cyclically moves up and down in the direction toward and away from the folding gap 86 is disposed above two driven folding rollers 2, 3 disposed axially parallel in respect to each other, and whose rotational axes 83, 84 are evenly distanced from each other, so that a folding gap 86 is created. In this case the signatures 71 consisting of the left and right elements 72, 73 are already preformed in the shape of a V because of the movement toward each other of their left and right elements 72, 73, so that the folding blade 87 need only have a short lift for producing a fold 78 in the signatures 71 along the fold line 74 as seen in FIG. 7. The profile side of the folding blade 87 oriented opposite the transport direction C of the signatures 71 can be provided with a ground portion at least in its lower area, i.e. in the area of its edge, so that it can better penetrate the incoming signatures 71 with their raised left and right elements 72, 73, if required.

Figure 8:
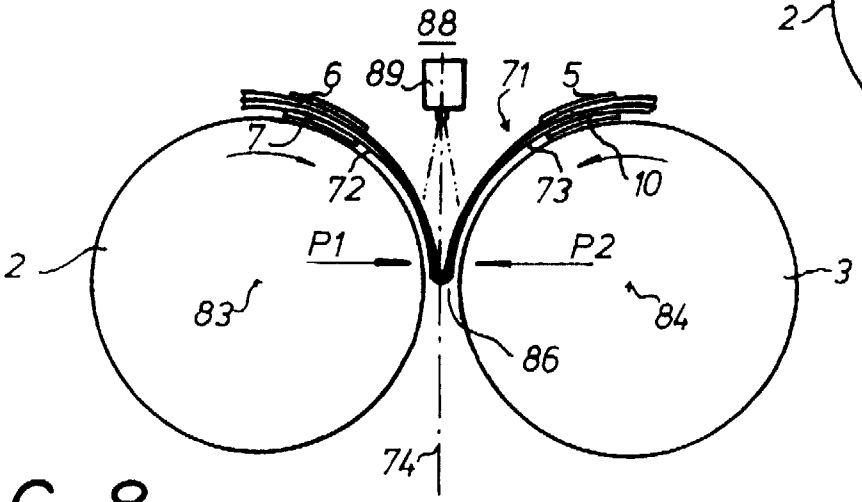

In accordance with a further preferred embodiment of a second longitudinal folding device, identified as a whole by 88 as seen in FIG. 8, a bar is disposed above the folding gap 86 between the axially parallel extending folding rollers 2, 3. In the axially parallel direction in respect to the rotational axes 83, 84 of the folding rollers 2, 3 this bar is provided with blower air nozzles 89, which blow air in the direction toward the folding gap 86. The signatures 71 composed of left and right elements have already been pre-shaped in the form of a V, so that the force of the air directed on the fold line 74 of the signatures 71 is sufficient to make a fold 78 in the signatures 71 or to introduce the signatures into the folding gap 86 of the folding rollers 2, 3 which are counter-rotating in the direction of the outflowing blown air.

Figure 9:
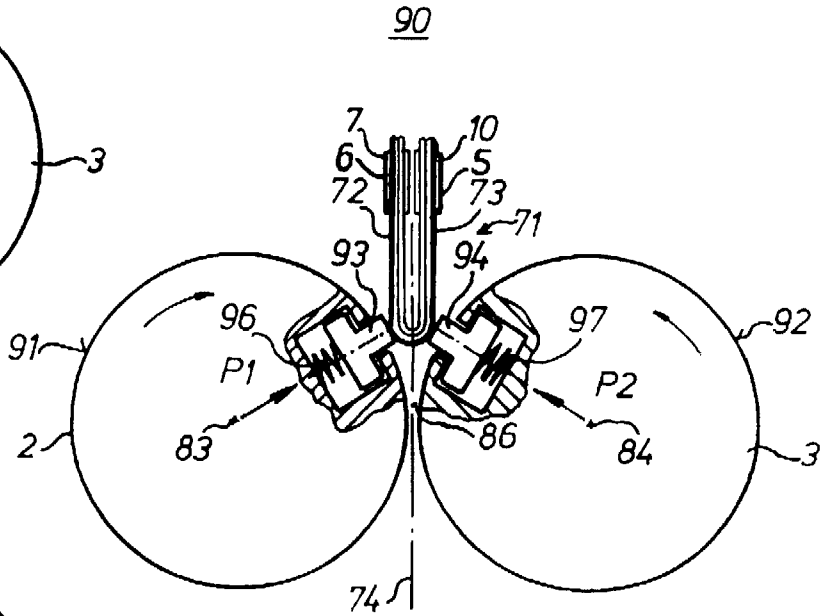

In a further preferred embodiment, a third longitudinal folding device, identified as a whole by 90 and as seen in FIG. 9, also has two driven folding rollers 2, 3 arranged axially parallel in relation to each other, the same as the first and second longitudinal folding devices 80, 88, and whose rotational axes 83, 84 are evenly spaced apart from each other in such a way that a folding gap 86 is also created between the two folding rollers 2, 3. The folding rollers 2, 3 also rotate synchronously in relation to each other and have carriers 93, 94 respectively extending beyond their periphery 91, 92 in the axially parallel direction. The carriers 93, 94 can be embodied to be rigid and can consist of a resilient material, for example of plastic. In another embodiment, the carriers 93, 94 can be movable, i.e. retractable into the jacket of the folding rollers 2, 3, for example against the force of springs 96, 97 as seen in FIG. 9 or by means of controlled drive elements, not shown. In this case the carriers 93, 94 can be embodied in the form of a bar or in the form of a plurality of bar segments arranged one behind the other in the axially parallel direction 83, 84 on the periphery 91, 92 of the folding cylinder 2, 3.

It is also possible to embody the folding rollers 2, 3 represented in FIG. 9 without the carriers 93, 94, and to provide folding rollers counter-rotating in the direction of an inlet wedge in place of them, whose circular cross sections consist of respective semicircles with respectively different radii, so that after each half turn of both folding rollers a common, but respectively different folding gap 86 is created. This folding gap 86 has the same effect as the carriers 93, 94. A common folding gap alternates with a slightly larger gap following each half turn of the folding rollers in relation to each other. Such folding rollers also rotate synchronously in respect to each other. The various gaps are created mirror-reversed in respect to the fold line 74.

Figure 10:
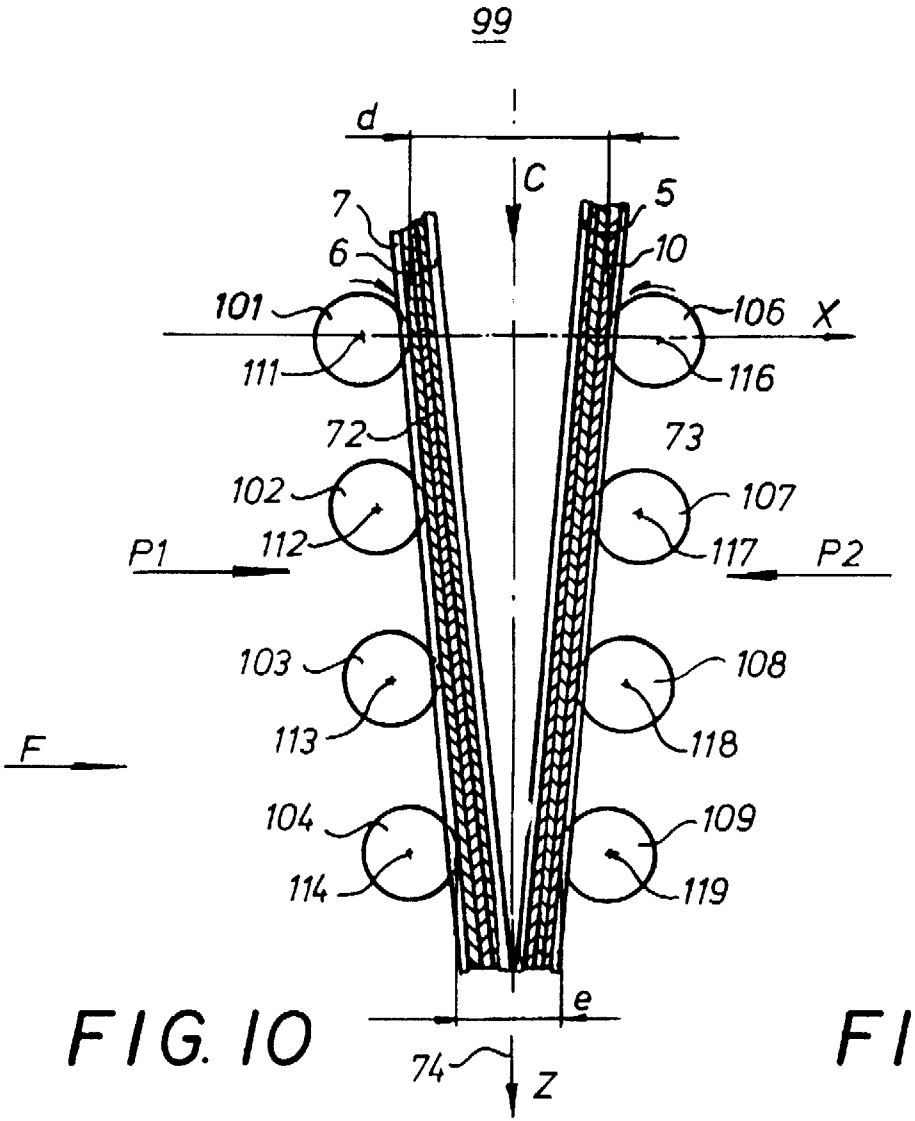

In a further preferred embodiment a fourth longitudinal folding device is identified as a whole by 99 as shown in FIG. 10. In this case a number of folding rollers 101, 102, 103, 104, 106, 107, 108, 109 are arranged in the transport direction C of the signatures 71 to the left and right of the fold line 74, and whose rotational axes 111, 112, 113, 114, 116, 117, 118, 119 extend perpendicularly to the transport direction C in the direction of the Y-axis of a right-angled coordinate system. The transport direction C corresponds to a Z-axis of a three-dimensional right-angled coordinate system. The clear distances d, e of a pair of rollers 111, 116, 104, 109 in the X-direction shown in FIG. 10 diminish in the transport direction C, so that by means of this a folding gap with the distance "e" is also provided at the end, which is equal to the folding gap 86. The folding rollers 101 to 104 and 106 to 109 act compressingly on at least one portion 79, 81 of the signatures 71 in the area of the fold line 74. A length "l" of the folding rollers 101 to 104 and 106 to 109 can be of such dimensions that they only act in the area of the fold line 74, as shown in FIG. 11, or these folding rollers can have a length corresponding to the width of a left or right element 72, 73 of a signature 71. It is furthermore possible, as represented in FIG. 5, to dispose a longitudinal guide 82 above the signatures 71 in order to be able to better make the V-shaped depression in the signatures 71, or to have, in addition to the holding means 6, 7, 5 10 and possibly further guide means still to be described, means touching the bottom of the fold to be made. This longitudinal guide 82 can be embodied in different ways and can also cooperate with a lower countersupport device 24 which may be seen in FIGS. 12 and 13.

Figure 13:
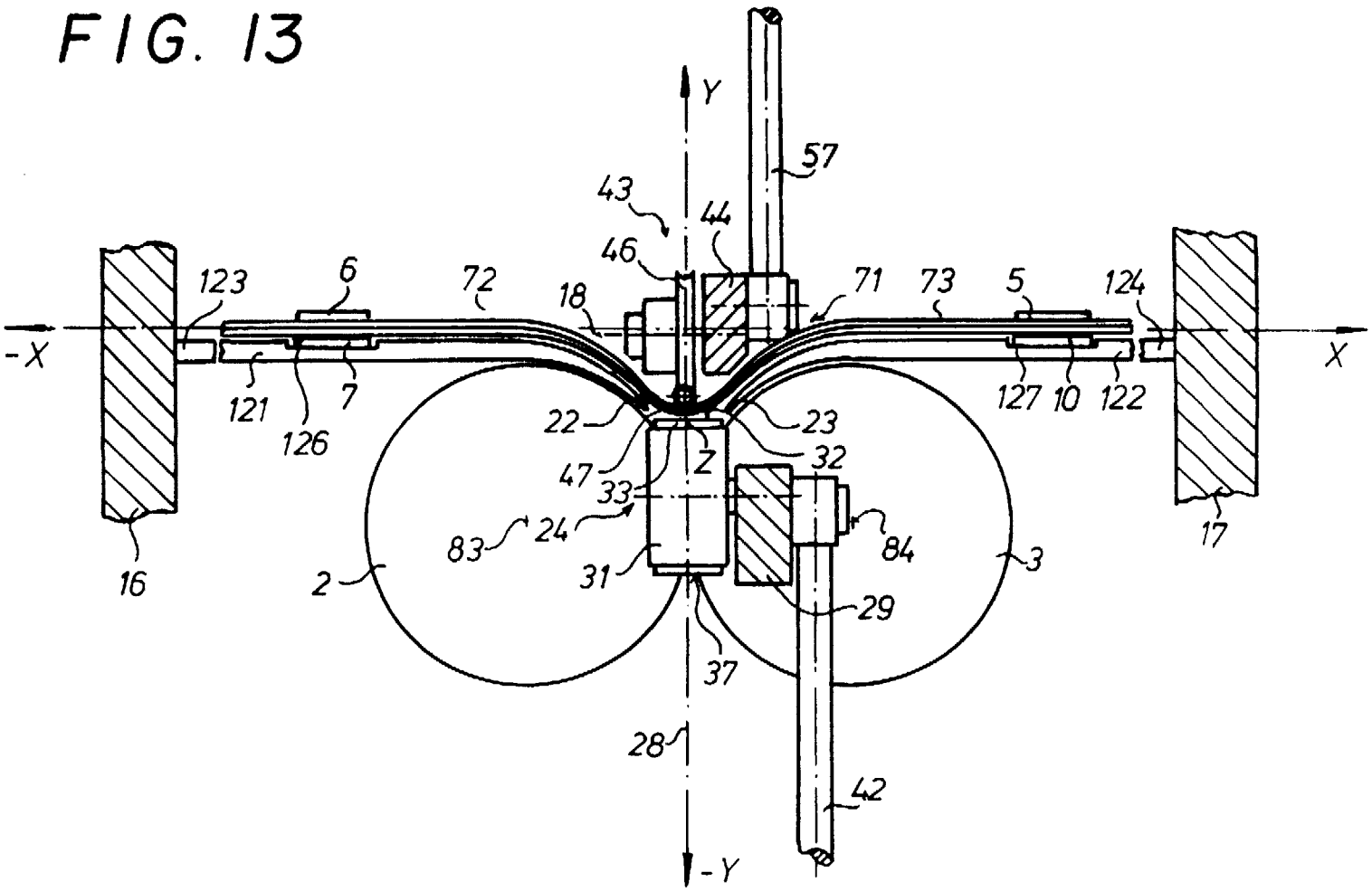

In a generally known manner, a longitudinal folding device 1 as may be seen in FIG. 12, consists of a driven pair of folding rollers 2, 3, a longitudinal folding blade 4 moving cyclically up and down, several driven upper conveyor belts 6, 5 and driven lower conveyor belts 7, 10, which accept signatures 71, already provided with a first transverse fold via driven belt guide systems 9, 11, from a folding apparatus 8 for longitudinal folding and then pass them on to a device, not shown, for example a paddle wheel. The upper conveyor belts 6, 5 as well as the lower conveyor belts 7, 10 extend further as far as downstream of the longitudinal folding device 1 and are driven by belt rollers, not shown. However, for the sake of clarity the second belt rollers 12, 13 disposed in the vicinity of the folding apparatus 8 are embodied as driven belt rollers. The belt roller 12 is seated on both sides at the end of two extension brackets 16, 17 fastened on a side frame 14 and extending in the direction toward the folding apparatus 8. An inlet conduit 18, as shown in FIG. 13, is located centered between the lower conveyor belts 7, 10 in the transport direction of the signatures 71 and extends, starting at the belt roller 13, horizontally in the direction of the longitudinal folding device 1 and terminates directly into an inlet wedge between the folding rollers 2, 3. The inlet conduit 18 is located between two inlet panels 121, 122, whose first long edges 123, 124 are interlockingly connected with side frames or extension brackets 16, 17. Their second long edges 22, 23 are bent in the direction toward the conduit bottom or arched in the direction of the Y-axis (minus) at a radius corresponding to the radius of the folding rollers 2, 3. The long edges 22, 23 border the conduit bottom in the X-direction of the right-angled coordinate system or can cooperate with a counter-support device, identified as a whole by 24. A line 74 of the future longitudinal fold extends in the center of the inlet conduit 18 and is defined by a perpendicular line 28 in the Y-direction. The counter-support device 24 comprises a number of spherical pulleys 31, seated aligned behind each other in a rail 29, which support an upper run 32 of an endless belt 33, whose lower run 37 is reversed via a reversing roller 34 and which is driven via the belt roller 13, all as seen in FIGS. 12 and 13.

This rail 29 is pivotably seated by its first end 38 fixed on the side frame on a shaft 39 which also supports the belt rollers 13. A second end 41 of the rail 29 is frictionally and interlockingly connected with an adjusting device 42 fixed on the side frame, which allows the vertical adjustment of this second end 41 of the rail 29. A wheel arrangement 43 as an embodiment of the longitudinal guide 82 also extends in the alignment of the inlet conduit 18 above the belt system or lower counter-support device 24 and parallel with it. This wheel arrangement 43 comprises a number of guide wheels 46 seated behind each other aligned on a rail 44, each of which guide wheels 46 has a groove, semicircular in cross section, on its circumference for receiving the lower run 47 of an endless upper belt 48 of circular cross section. The upper belt 48 extends in the production direction below the guide wheels 46 parallel with the upper run 32 of the lower belt 33, its upper run 52 is returned via a reversing roller 49 and a tension roller 51 and is driven by the belt roller 12. With its first end 53 fixed on the side frame, the rail 44 is pivotably seated on a shaft 54. A second end 56 of the rail 44 is frictionally and interlockingly connected with an adjustment device 57 fixed on the side frame, which allows the vertical adjustability of this second end 56 of the rail 44 against the force of a spring, not shown. The guide wheels 46 of the upper rail 44 are respectively disposed "staggered" in respect to the pulleys 31 of the lower rail 29, i.e. a straight line drawn through a rotational axis 59 of a pulley and extending at right angles to the inlet conduit 18 inclined in the direction toward the longitudinal folding device bisects a distance "a" between two adjoining guide wheels 46 disposed on the upper rail 44, as shown in FIG. 12. The number of guide wheels 46 can be at a ratio of 1:1 or preferably a ratio of 2:1 in respect to the number of pulleys 31. The even, i.e. quiet, passage of the signatures through the device of the invention during the pre-folding process is assured by means of this "staggered" disposition of the guide wheels 46 in respect to the pulleys 31.

The mode of operation of this longitudinal guide 82, which acts against the lower counter-support device 24, is as follows: The signatures 71 conveyed from the folding apparatus 8 via the belt guide system 9, 11 are conducted between the upper and lower conveyor belts 6, 7, 5, 10. Viewed in the production direction, the underside of the signatures 71 rests centered on the upper run 32 of the belt 33. There is then a distance between the upper run 32 of the belt 33 and the lower run 47 of the belt 48, which corresponds to the thickness of the signatures 71. This distance can be preset by means of the adjusting devices 42, 57. During the conveyance of the signatures 71 by the conveyor belts 6, 7, 5, 10, the belt 48 presses, in alignment with the future longitudinal fold 74, on the signatures 71 by means of the resilient force of the rail 44. Because of the inclination of the lower rail 29 as well as the upper rail 44 by respectively 3° in relation to the horizontal, while the left and right elements 72, 73 of the signatures 71 remain in the horizontal position, the signatures 71 are provided with a pre-fold of a depth of approximately 30 to 35 mm in the manner of an embossing or a deep-drawing process after their rear edge or rear border has left the belts 33, 48. Their folds are finished in the longitudinal folding device 1. In this respect the longitudinal folding process is two-staged in that the signatures 71 are pre-folded on the fold line 74 and the folding is subsequently finished in the longitudinal folding device 2, 3, 4. The folded products are supplied to a paddle wheel, not shown, following the completion of this longitudinal fold 78. In the process, the folded products can be aligned front and back by means of two guide panels before they reach the paddle wheel. The rear guide panel is identified by 58 and shown in FIG. 12 of the drawings. The belt 33 can consist of plastic of intermediate hardness with a textile insert. The belt 48 is embodied as a round belt and can also be made of plastic of an intermediate hardness.

On their circumference the guide wheels 46 of the longitudinal guide 82 can have a groove with a V-shaped cross section in place of a groove with a semi-circular cross section for receiving the lower run 47 of the belt 48, so that it is also possible to employ an endless belt with a rhomboidal cross section.

In accordance with another embodiment of the longitudinal guide 82, the guide wheels 46 do not support a belt 48, but instead are driven by drive elements, not shown, for example by means of toothed gears disposed on the same shaft with the guide wheels 46. In this case the wheel arrangement 43 can perform the function of a longitudinal guide 82 wherein the left and right elements 72, 73 of the signature 71 are moved toward each other at an inner distance "b", for example b4 as seen in FIG. 5, as well as act against a counter-support device 24 located below the wheel arrangement 43. In this case the distance f2 at its fold line 74 of the lowermost sheet 69 in relation to its ends 76, 77 located in the X-plane is at least twice the thickness of the signature 71. So-called "creasing" or permanent deformation of the paper fiber of the signature 71 in the fold line 74 is caused respectively by the longitudinal guide 82.

It is furthermore possible to embody the longitudinal guide 82 with a knife 82 with a dull edge in place of the guide wheels 46 as seen in FIG. 5.

The holding means embodied as upper and lower conveyor belts 6, 7, 5, 10 can be guided in the surface of the inlet panels 121, 122, for example in channels 126, 127 extending in the transport direction C and adapted to the cross section of at least the lower conveyor belts 7. As already explained, several conveyor belts 6, 7, 5 10 can be disposed, extending parallel to each other, in the inlet panels 121, 122.

The operation of the device for the production of a longitudinal fold in accordance with the present invention can be summarized as follows:

A signature 71 consisting for example of several sheets is transported, "clamped" on its right and left element 73, 72 bordering the intended fold line 74 between the upper and lower conveyor belts 6, 7; 5, 10. In the process the signature 71 undergoes a movement in the direction towards the downstream located longitudinal folding device 1, 80 and in the intended folding direction. The signatures 71 pass through a pre-folding device 24, 82 on their way to the longitudinal folding device 1, 80. The signature 71 is pre-folded in a "v-shape" in this pre-folding device 24, 82. The base line of the v-shaped pre-shape of the signature 71 forms the imagined fold line 74. On its way to the longitudinal folding device 1, 80, the intended folding area is considerably lowered in the direction toward the intended folding direction. Such lowering is by 30 to 50 mm, for example. Lowered in this way, the signature moves against a stop between the folding blade edge of the folding blade 87 or in the pushing device, in the area of the greatest approach of the folding rollers 2, 3, the folding roller gap 86. The folding roller gap 86 can be adjusted within limits and can also by zero millimeters. In this case, the journals of the folding rollers 2, 3 are resiliently seated. A distance between the lowermost position of the signature 71 and the folding roller gap can be between 10 and 20 mm. Subsequently the folding blade 87 merely needs to perform a movement originating in the interior of the inlet wedge area from an upper position, i.e. a lifting movement of small lift length, for example 20 to 30 mm, in a perpendicular direction in order to press the signature 71 along the pre-formed fold line 74 between the rotating folding rollers 2, 3. The rotational axes 83, 84 of the folding rollers 2, 3 extend in this case next to, i.e. parallel with the intended fold line 74.

The inlet wedge area between the two folding rollers 2, 3 has a contour as described below:

a connecting line extending in the horizontal direction at the place of the shortest distance between the folding rollers 2, 3; i.e. the folding roller gap 86, a quarter circle of the circumference of the left folding roller 2 as seen in FIG. 7 in the I. quadrant of a rectangular coordinate system extending through the rotational axis 83 of the folding roller 2, a quarter circle of the circumference of the right folding roller 3 as seen in FIG. 7 in the II. quadrant of a rectangular coordinate system extending through the rotational axis 84 of the folding roller 3, a horizontal connecting section between the highest points of the circumferences at both folding rollers 2, 3.

In place of the up-and down-moving folding blade 87 it is of course also possible to provide a blower air device 89 or carrier bars 93, 94 resiliently disposed in the folding rollers 2, 3. In this case the signature 71, pre-formed in a v-shape, enters the longitudinal folding device 1, 80 below the blower air nozzles 89. Because the weighty folding blades 87 only need to perform a small lift, it is possible to considerably increase the folding speed.

The movement of the folding blade 87 originating from the interior of the inlet wedge area can also take place from an upper standby position.

I claim:

1. A method for producing a fold in a signature including the steps of:

clamping a signature on the left and right of an intended fold line between upper and lower conveyor belts;

feeding said clamped signature along a signature transport path in a signature transport direction;

placing a signature pre-folding device in said signature transport path;

passing said clamped signatures through said pre-folding device;

forming a prefold in said clamped signatures during passage through said pre-folding device;

locating a signature longitudinal folding device along said signature transport path after said pre-folding device;

providing first and second spaced rotary folding rollers in said longitudinal folding device, said spaced folding rollers defining an inlet wedge area and having a folding roller gap;

positioning said spaced rotating folding rollers with rotational axes parallel with said folding roller gap;

providing a pushing device acting perpendicularly with respect to said transport direction of said signatures for moving said signatures into said inlet wedge area and for pressing said signatures into said folding roller gap;

supplying said signatures to said longitudinal folding device already prefolded by said pre-folding device;

moving said pre-folded signatures into said folding roller gap by using said pushing device; and transporting said pre-folded signatures through said folding roller gap by rotation of said folding rollers to create a final fold in said pre-folded signatures.

2. The method of claim 1 further including prefolding said signatures in a V-shape along an intended fold line in said pre-folding device prior to entry of said signatures into said longitudinal folding device from said pre-folding device.

3. The method of claim 2 further including providing said pushing device as a folding blade having a lower edge; and positioning said V-shaped prefolded signature portions in said folding roller gap and originating movement of said folding blade in said inlet wedge area for producing said fold in said signatures.

4. A method for producing a fold in a signature including the steps of:

clamping a signature left and right of an intended fold line between upper and lower conveyor belts;

feeding said clamped signatures along a signature transport path in a signature transport direction;

placing a signature pre-folding device in said signature transport path;

passing said clamped signatures through said pre-folding device;

forming a pre-fold in said clamped signatures during passage through said pre-folding device;

locating a signature longitudinal folding device along said signature transport path after said pre-folding device;

providing two rotating folding rollers having a folding roller gap and an inlet wedge area in said longitudinal folding device;

positioning said two rotating folding rollers with their rotational axes extending parallel with said folding roller gap;

providing a signature pushing device having a lower folding edge which is movable perpendicularly to said transport direction of said signatures to be folded into said folding roller gap;

providing said signatures to be folded with a V-shaped deformation along their intended fold line in said pre-folding device;

moving said V-shaped deformation between said folding edge of said pushing device, which has dipped into said inlet wedge area, and said folding roller gap;

inserting said pre-folded signatures into said folding roller gap by downward movement of said pushing device;

grasping said pre-folded signatures in an area of an intended fold with said folding rollers; and transporting said pre-folded signatures through said folding roller gap by rotation of said folding rollers to create a final fold in said pre-folded signatures.

5. The method of claim 1 further including terminating movement of said signatures in said transport direction prior to operating said perpendicularly acting pushing device.

6. The method of claim 4 further including terminating movement of said signatures in said transport direction prior to operating said perpendicularly acting pushing device.

7. The method of claim 1 further including moving said signature portions clamped on said left and right of said intended fold line in said pre-folding device toward each other a pre-selectable distance.

8. The method of claim 4 further including moving said signature portions clamped on said left and right of said intended fold line in said pre-folding device toward each other a pre-selectable distance.

9. The method of claim 7 further including moving said signature portions clamped on said left and right of said intended fold line toward each other while feeding said signatures in said pre-folding device to said longitudinal folding device.

10. The method of claim 8 further including moving said signature portions clamped on said left and right of said intended fold line toward each other while feeding said signatures in said pre-folding device to said longitudinal folding device.

11. The method of claim 1 further including arranging said signature portions clamped on said left and right of said intended fold line in said pre-folding device symmetrically with respect to said intended fold line.

12. A device for producing a fold in a signature comprising:

spaced upper and lower conveyor belts extending along a signature transport path in a signature transport direction of a signature to be folded and adapted to clamp a signature on the left and right of an intended fold line;

a signature pre-folding device located in said signature transport path;

means feeding said signatures through said pre-folding device along said signature transport path in said signatures transport direction to form a pre-fold in said signatures;

a longitudinal signature folding device positioned after, along said signature transport path in said transport direction, said pre-folding device, said folding device including driven folding rollers disposed to the left and right of said fold line and rotatably supported axially parallel to said fold line and defining a folding gap; and a folding blade moving cyclically up and down in said folding gap, said folding blade forcing said pre-folded signatures into said folding gap.

13. The device in accordance with claim 12 wherein said folding blade is provided with a folding blade edge which can be moved from a standby position in the direction of said folding roller gap and back to said standby position.

14. A device for producing a fold in a signature comprising:

spaced upper and lower conveyor belts extending along a signature transport path in a signature transport direction of a signature to be folded and adapted to clamp a signature on the left and right of an intended fold line;

a signature pre-folding device located in said signature transport path;

means feeding said signatures through said pre-folding device along said signature transport path, in said signatures transport direction to form a pre-fold in said signatures;

a longitudinal signature folding device positioned after, along said signature transport path in said transport direction, said pre-folding device, said folding device including driven folding rollers disposed to the left and right of said fold line and rotatably supported axially parallel to said fold line and defining a folding gap; and a bar provided with air nozzles directed into said folding gap and extending axially parallel with said folding rollers, said bar with air nozzles forcing said pre-folded signatures into said folding gap.

15. A device for producing a fold in a signature comprising:

spaced upper and lower conveyor belts extending in a transport direction of a signature to be folded and adapted to clamp a signature on the left and right of an intended fold line;

means feeding said signatures along a pre-folding device in said signatures transport direction to form a pre-fold in said signatures; and a longitudinal signature folding device positioned after, in said transport direction, said pre-folding device, said folding device including driven folding rollers disposed to the left and right of said fold line and rotatably supported axially parallel to said fold line and defining a folding gap, said folding rollers each having carriers positioned axially along their peripheral surfaces and extending beyond said peripheral surfaces.

16. The device of claim 12 wherein said pre-folding device includes a plurality of pairs of pre-folding rollers positioned to the left and right of said fold line and having rotational axes which extend perpendicularly to said transport direction, each roller in each of said pairs of pre-folding rollers being equally spaced from said fold line, said pre-folding rollers acting on said signatures at least in the immediate area of said fold line.

17. The device of claim 15 wherein said carriers are arranged on a bar in a jacket surface of said folding rollers.

18. The device of claim 17 wherein said carriers extend in said jacket surface of said folding rollers on sections of said bar disposed axially behind each other.

19. The device of claim 15 wherein said carriers are rigid.

20. The device of claim 15 wherein said carriers are resilient.

21. A device for forming a pre-fold along an intended fold line in a signature to be folded in a signature folding device comprising:

first and second spaced inlet panels positioned in a transport direction of signatures to be folded before said signatures folding device, said spaced inlet panels defining an inlet conduit;

first long edges of said inlet panels connected with a frame of said signature folding device;

second long edges of said inlet panels being bent in a direction toward a conduit bottom of said inlet conduit;

a longitudinal guide extending in said transport direction and disposed above said conduit bottom of said inlet conduit, said longitudinal guide being adjustable to vary an inclination of said longitudinal guide; and signature holding, means extending along said inlet panels and movable in said transport direction.

22. The device of claim 21 wherein said longitudinal guide is a knife.

23. The device of claim 21 wherein said longitudinal guide is a roller support including a rail and having a plurality of guide wheels seated aligned along said rail in said transport direction.

24. The device of claim 21 wherein a first end of said rail is pivotably supported by a shaft which also receives a belt roller and further wherein a second end of said rail is adjustable against a lower counter-support device by an adjustment device secured to said frame.

25. The device of claim 23 wherein said guide wheels are driven.

26. The device of claim 23 wherein each of said guide wheels has a circumferential groove which is semicircular in cross-section.

27. The device of claim 24 wherein said guide wheels, on their sides facing said counter-support device guide a lower run of an endless belt.

28. The device of claim 27 wherein each of said guide wheels has a circumferential groove with a V-shaped cross-section and further wherein said endless belt has a rhomboid shaped cross-section.

29. The device of claim 24 wherein said counter-support device includes a plurality of spaced pulleys secured to a counter-support rail, said pulleys supporting an upper run of an endless driven belt.

30. The device of claim 29 wherein a first end of said counter-support rail is pivotably seated on a shaft which also supports a belt roller and further wherein a second end of said counter-support rail is adjustable with respect to said longitudinal guide by a counter-support adjustment device secured to said side frame.

31. The device of claim 29 wherein a straight line drawn through a rotational axis of one of said counter-support pulleys and which extends at a right angle to said inlet conduit bisects a spacing distance between adjacent ones of said guide wheels on said rail of said roller support.

32. The device in accordance with claim 31 wherein a ratio of the number of guide wheels to the number of pulleys is 1:1.

33. The device in accordance with claim 31 wherein a ratio of the number of guide wheels to the number of pulleys is 2:1.

34. The device of claim 21 wherein said signature holding means consists of upper and lower conveyor belts which grip left and right elements of a signature to be folded in a sandwich-like grip.

* * * * *